US006601941B1

(12) United States Patent
Jones et al.

(10) Patent No.: US 6,601,941 B1
(45) Date of Patent: Aug. 5, 2003

(54) METHOD AND APPARATUS FOR PREDICTING AND LIMITING MAXIMUM PRINTHEAD CHIP TEMPERATURE IN AN INK JET PRINTER

(76) Inventors: Christopher Dane Jones, 991 Crumbaugh Rd., Georgetown, KY (US) 40324; Bryan Scott Willett, 205 Woodbrook Pl., Lexington, KY (US) 40511; Shirish Padmaker Mulay, 1320 Norcross Ct., Lexington, KY (US) 40513

( * ) Notice: Subject to any disclaimer, the term of this patent is extended or adjusted under 35 U.S.C. 154(b) by 0 days.

(21) Appl. No.: 09/617,583

(22) Filed: Jul. 14, 2000

(51) Int. Cl.[7] ..... B41J 29/393

(52) U.S. Cl. ..... 347/19; 347/14; 347/17; 347/18; 347/180; 347/181; 347/182

(58) Field of Search ..... 347/14, 17, 18, 347/180, 181, 182, 194

(56) References Cited

U.S. PATENT DOCUMENTS

| | | | | |
|---|---|---|---|---|
| 4,536,774 A | | 8/1985 | Inui et al. | |
| 4,791,435 A | | 12/1988 | Smith et al. | |
| 4,872,028 A | | 10/1989 | Lloyd | |
| 4,910,528 A | * | 3/1990 | Firl et al. | 347/18 |
| 4,980,702 A | | 12/1990 | Kneezel et al. | |
| 5,036,337 A | | 7/1991 | Rezanka | |
| 5,107,276 A | | 4/1992 | Kneezel et al. | |
| 5,159,693 A | * | 10/1992 | Tatsuzawa | 395/800 |
| 5,168,284 A | | 12/1992 | Yeung | |
| 5,300,969 A | | 4/1994 | Miura et al. | |
| 5,315,316 A | | 5/1994 | Khormaee | |
| 5,745,132 A | | 4/1998 | Hirabayashi et al. | |
| 5,815,173 A | | 9/1998 | Silverbrook | |
| 5,841,452 A | | 11/1998 | Silverbrook | |
| 5,877,785 A | | 3/1999 | Iwasaki et al. | |
| 5,907,331 A | | 5/1999 | Markham | |
| 5,986,684 A | | 11/1999 | Ohashi | |
| 6,019,449 A | | 2/2000 | Bullock et al. | |
| 6,019,457 A | | 2/2000 | Silverbrook | |
| 6,116,709 A | * | 9/2000 | Hirabayashi et al. | 347/14 |
| 6,145,959 A | * | 11/2000 | Lund et al. | 347/40 |
| 6,213,579 B1 | * | 4/2001 | Cornell et al. | 347/14 |

FOREIGN PATENT DOCUMENTS

EP 0872345 A2 10/1998

* cited by examiner

*Primary Examiner*—Thinh Nguyen
*Assistant Examiner*—Ly T Tran

(57) ABSTRACT

A method of controlling a temperature of a print chip of a printhead in an ink jet printer includes providing a memory device within the printer. Ink is emitted from the printhead. Temperature data associated with the print chip during the emitting step is recorded. A thermal resistance value associated with the printhead and/or a thermal capacitance value associated with the printhead is calculated. The calculating is dependent upon the recorded temperature data. The thermal resistance value associated with the printhead and/or the thermal capacitance value associated with the printhead is stored in the memory device. A temperature of the print chip at a future point in time is estimated based upon a number of ink drops to be emitted by the printhead before the future point in time, and the thermal resistance value associated with the printhead and/or the thermal capacitance value associated with the printhead. The thermal resistance and/or the thermal capacitance values vary with the print power, target temperature, and heatsink temperatures. The estimated temperature is compared to a predetermined limit temperature. If the estimated temperature exceeds the predetermined limit temperature, the number of ink drops to be emitted by the printhead before the future point in time is reduced.

23 Claims, 7 Drawing Sheets

METHOD AND APPARATUS FOR PREDICTING AND LIMITING MAXIMUM PRINTHEAD CHIP TEMPERATURE IN AN INK JET PRINTER

BACKGROUND OF THE INVENTION

1. Field of the Invention

The present invention relates to an ink jet printhead, and, more particularly, to a method and apparatus for predicting and limiting maximum printhead chip temperature in an ink jet printer.

2. Description of the Related Art

In an ink jet printer, excessive print density can cause several problems within the printer. One of these problems is excessive print chip temperature. In order to avoid excessive chip temperature, the printer must pre-analyze data and be able to predict the temperature of the print chip.

In previous ink jet printers, the basic approach was to count the number of drops in the next pass of the printhead. If the drop count were too high, the single pass would be broken into multiple passes. This previous approach does not accurately predict the print chip's temperature. When the print system is composed of an ink jet chip that is mounted on a metal heatsink and the chip has built-in substrate heaters which are used to regulate temperature, a new approach to prediction is required.

In an ink jet printer, the drop and mass of the ink are dependent upon the temperature of the head. If the temperature of the head varies significantly from swath to swath, then a color shift will become visible, a phenomenon which is referred to as "banding." In order to overcome this problem, ink jet printers typically add heat to the print chips by the use of substrate heaters. By attaching the print chip to a metal heatsink, swings in chip temperature can be further reduced.

As ink jet printers begin to move into the business market, it becomes necessary to manage the printhead in a more efficient manner. Even with the addition of heat and the attachment to a metal heatsink, due to the number of nozzles present on the chip, it is still possible to cause excessive swings in chip temperature when printing high-density images. This requires that the printer be able to predict the temperature of the print chips for future swaths.

SUMMARY OF THE INVENTION

The present invention provides a method of accurately determining whether a temperature of a print chip in an ink jet printer will exceed a predetermined limit temperature based upon a number of ink drops to be emitted, and, if so, reducing the number of ink drops to be emitted such that the predetermined limit temperature is not exceeded.

The invention comprises, in one form thereof, a method of controlling a temperature of a print chip of a printhead in an ink jet printer. A memory device is provided within the printer. Ink is emitted from the printhead. Temperature data associated with the print chip during the emitting step is recorded. A thermal resistance value associated with the printhead and/or a thermal capacitance value associated with the printhead is calculated. The calculating is dependent upon the recorded temperature data. The thermal resistance value associated with the printhead and/or the thermal capacitance value associated with the printhead is stored in the memory device. The memory device also sets the amount of energy applied for each drop. A temperature of the print chip at a future point in time is estimated based upon a number of ink drops to be emitted by the printhead before the future point in time, and the thermal resistance value associated with the printhead and/or the thermal capacitance value associated with the printhead. The estimated temperature is compared to a predetermined limit temperature. If the estimated temperature exceeds the predetermined limit temperature, the number of ink drops to be emitted by the printhead before the future point in time is reduced.

The invention comprises, in another form thereof, an ink jet printer including a printhead having a print chip. A memory device stores a thermal resistance value associated with the printhead and/or a thermal capacitance value associated with the printhead. The memory device also sets the amount of energy applied for each drop. A controller retrieves the thermal resistance value associated with the printhead and/or the thermal capacitance value associated with the printhead from the memory device. The controller calculates a maximum temperature of the print chip during printing based upon the thermal resistance value associated with the printhead and/or the thermal capacitance value associated with the printhead.

An advantage of the present invention is that the temperature of the print chip can be more accurately predicted.

Another advantage is that the temperature of the print chip can be more reliably prevented from exceeding a predetermined limit temperature.

The method of the present invention incorporates the effect of the metal heatsink into the prediction of chip temperature. Data analysis occurs in groups that are much smaller than the thermal time constant of the system. While most ink jet printers simply count the number of drops in a swath and decide what action to take based on that count, the method of the present invention includes analyzing drop counts in groups that are smaller than an entire swath. A swath is commonly known as the set of print data that can possibly be printed in one complete pass of a printhead across a print medium. In order to improve print quality, however, the actual printing of a swath of data is often spread out over the course of multiple passes of the printhead across the print medium. Analyzing drop counts in groups that are smaller than an entire swath improves the accuracy of maximum temperature prediction.

Information contained in the memory device associated with the printhead is used to establish an approximate amount of energy per drop of ink. By multiplying the drop count per group by the energy per drop, the total energy per group is computed. The power required per group is computed based on the time required to print each group.

The print chip's response is predicted with a simple exponential model that contains thermal parameters that are not constant. The thermal parameters determine the chip's response to heating and describe how the chip cools. These parameters are based on two items: the power applied for each group and the difference between the chip's target control temperature and its heatsink temperature.

A calibration sequence occurs in the machine whenever a new printhead is installed. The printhead is jetted at a known fire rate and temperature data is recorded. This information is used to adjust the nominal thermal parameter tables stored in the machine.

By applying a difference equation, the change in chip temperature across the swath is predicted. Based on the maximum predicted temperature, the printer can shingle the entire page at a higher rate or switch to a higher shingle rate within the page.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
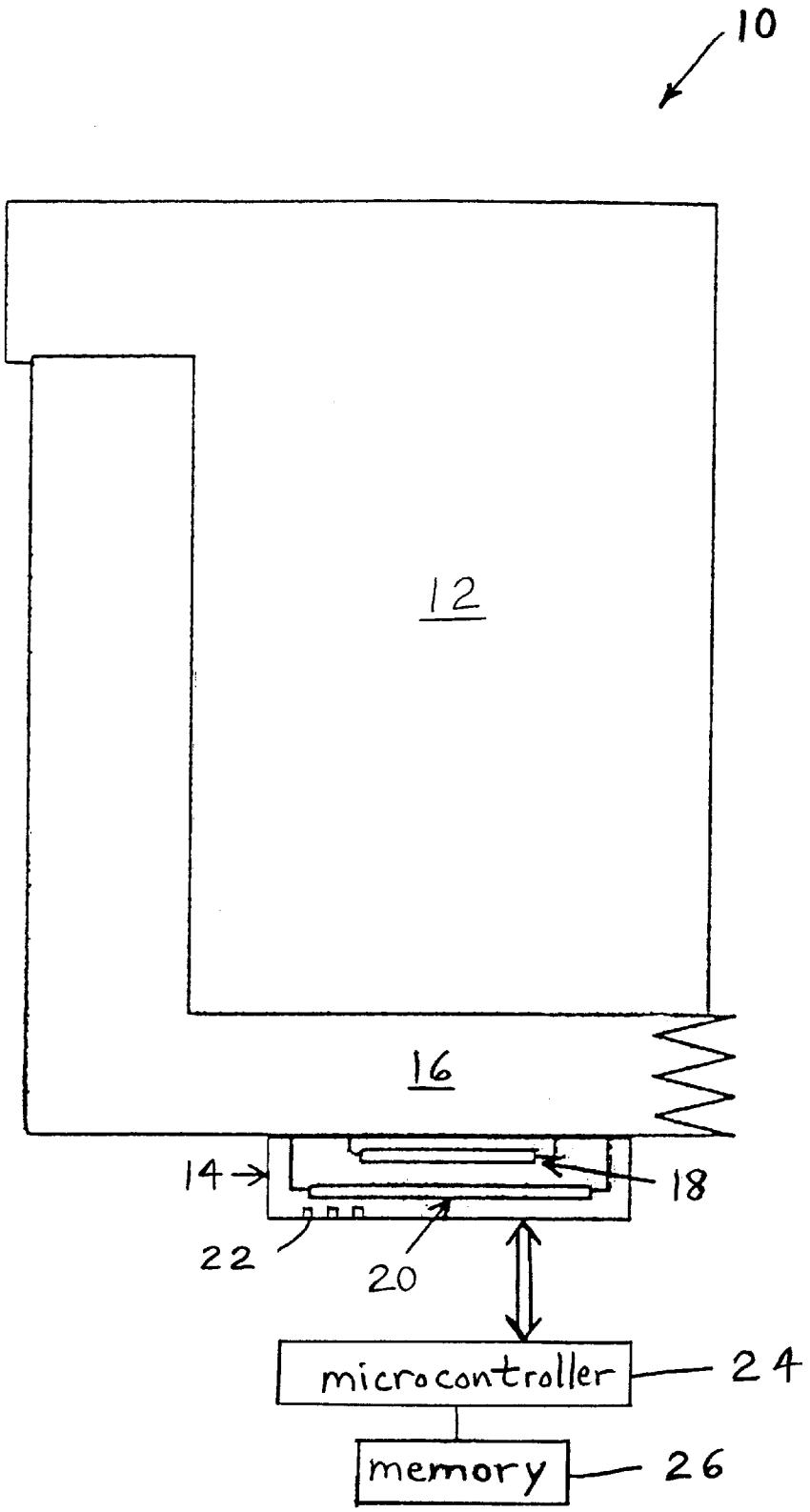
FIG. 1 is a schematic view of a printhead, microcontroller and associated memory that can be used in the method of the present invention.

Referring now to the drawings and particularly to FIG. 1, there is shown one embodiment of a printhead 10 that can be used in the method of the present invention. Printhead 10 includes an ink tank 12 and an ink jet chip 14 mounted to a metal heatsink 16. Print chip 14 includes an on-chip temperature sense resistor 18 for measuring the chip's temperature, and a substrate heater 20 which allows the application of additional power to chip 14. Ink jet chip 14 includes ink-emitting nozzles 22, only a few of which are shown. Ink jet chip 14 is in bi-directional communication with a microcontroller 24 connected to a memory device 26 within the printer. Memory device 26 can be attached to print chip 14.

Figure 2:
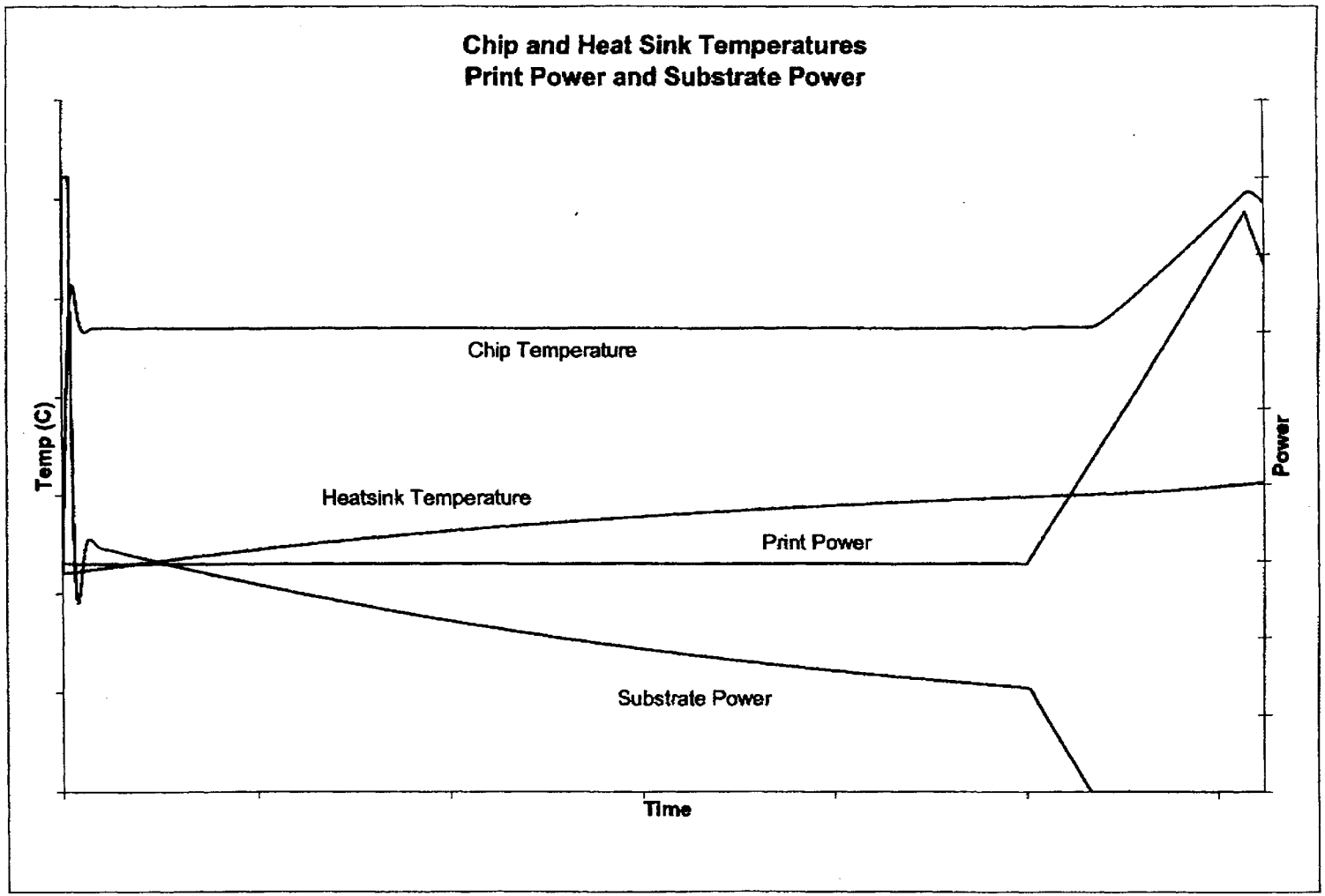
FIG. 2 is a plot of print chip temperature, heatsink temperature, power consumed during printing, and power applied to the substrate heaters.

The temperature of chip 14 is maintained by applying power to substrate heaters 20 when the chip's temperature is below the desired target value, and by turning off power to substrate heaters 20 whenever the chip's temperature is above the target temperature. In the absence of power being applied to substrate heaters 20, power applied for the ejection of ink while printing causes the temperature of chip 14 to rise. With power being applied to substrate heaters 20, the additional power produced by printing only results in less substrate heater power being required to maintain the target temperature. This phenomenon is illustrated in FIG. 2.

When the power due to printing reaches a certain level, the substrate power becomes zero. At this point, the heat produced from printing is sufficient to maintain the target temperature of chip 14. If the heat from printing exceeds a certain value, the temperature of chip 14 rises above its target temperature. Regulation of the target temperature is maintained for print densities below a certain value that is related to both the target temperature and the temperature of heatsink 16. As long as the excursion of the temperature of chip 14 remains relatively small, no noticeable effect is visible in print quality.

Figure 3:
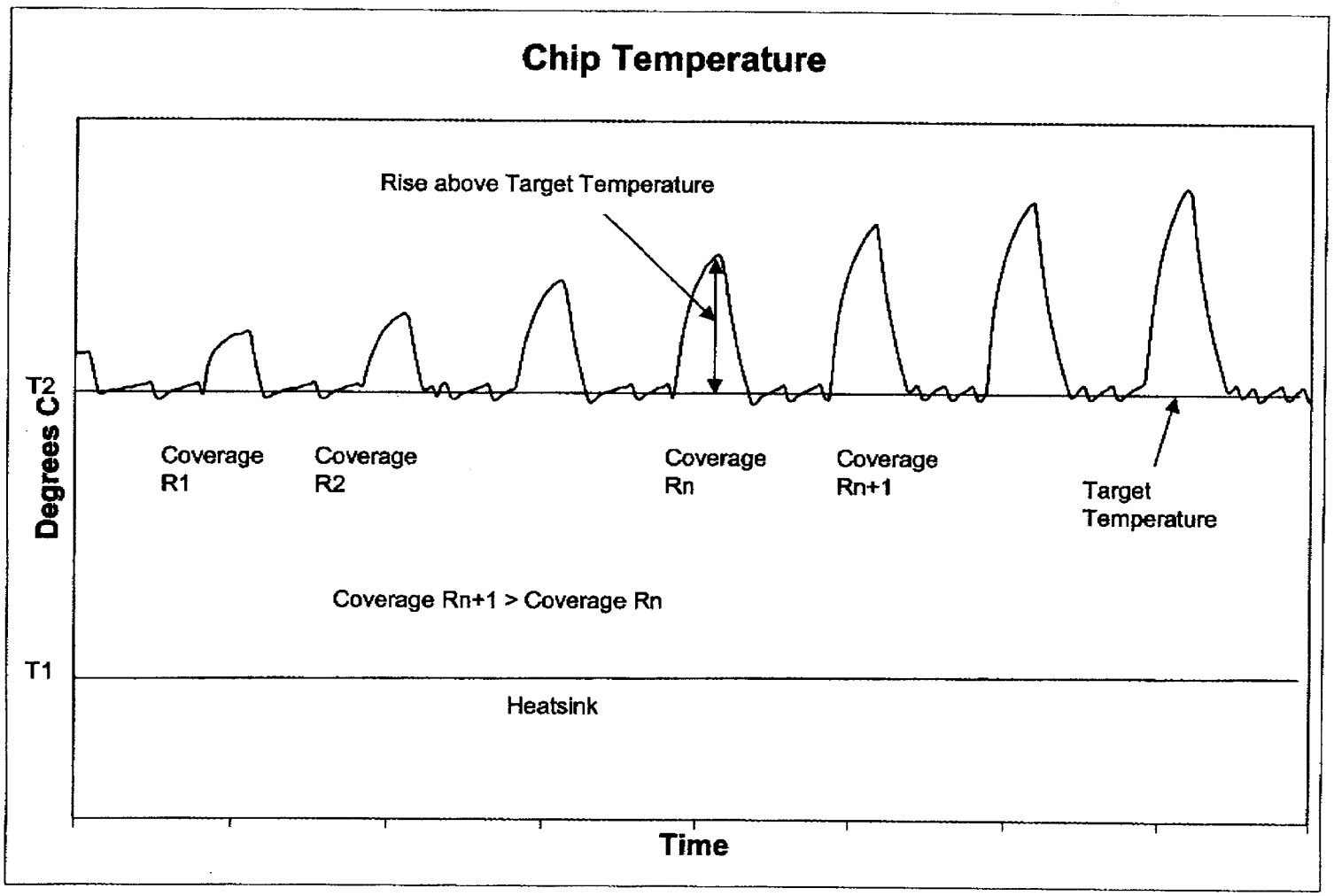
FIG. 3 is a plot of print chip temperature while printing increasingly denser swaths.

When the power produced from printing exceeds the power required to maintain chip 14 at its target temperature, the temperature of chip 14 rises with an exponential type rise. Shown in FIG. 3 is a plot of chip temperature data that was collected while the machine printed increasingly denser swaths. During the printing of the first full swath, the level of coverage is R1. During the printing of the second full swath, the level of coverage R2 is higher than R1. The level of coverage during the printing of each swath is higher than the level of coverage during the immediately preceding swath. That is, the level of coverage during swath n+1 is greater than the level of coverage during swath n, such that the following relationship holds: Coverage Rn+1>Coverage Rn. During the printing of each swath, the temperature of chip 14 rises above the target temperature in an exponential manner.

An equation that models the rise of the temperature of chip 14 above target is shown in Equation (1) below:

$$\Delta T=\Delta t*[P/C-T/RC] \qquad \text{Equation (1)}$$

wherein P is the power applied while printing, Δt is the time period in which the power is being applied to chip 14, T is the present chip temperature, ΔT is the change in chip temperature, C is the thermal capacitance of the system, and R is the thermal resistance of the system.

The rise above target temperature T2 can be expressed as a function of time in terms of the variables t, P, R and C, as shown in Equation (2):

$$T(t)=P*R*e^{-t/RC} \qquad \text{Equation (2).}$$

Figure 4:
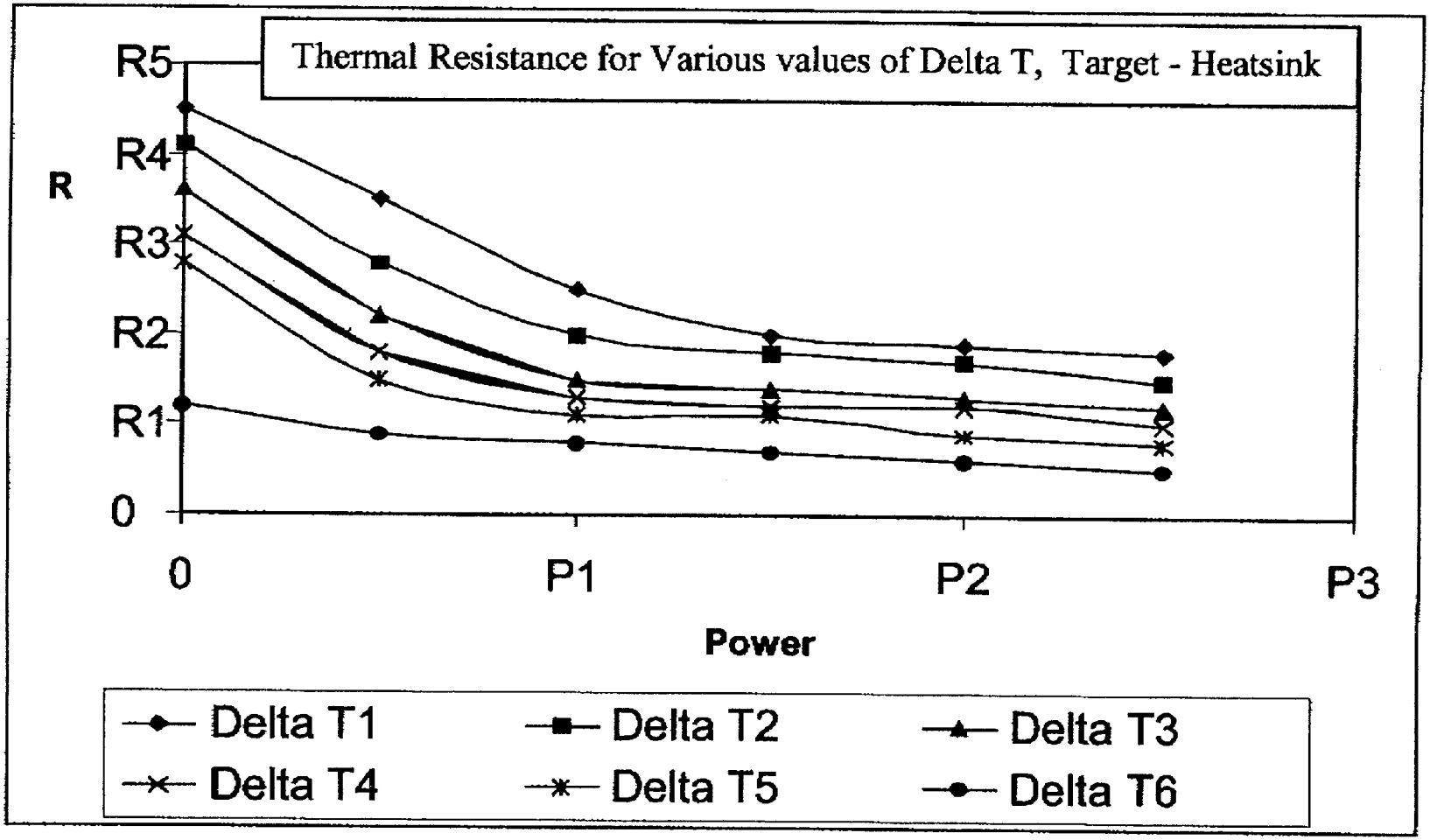
FIG. 4 is a plot of the thermal resistance of the print chip versus power consumed during printing for various values of the difference between the target temperature of the print chip and the heatsink temperature.

The values of R and C vary with the value of P. Tables are stored in memory 26 that provide, for a typical print chip 14, the values of R and C as a function of the level of power applied and also as a function of the difference (Delta T) between the target temperature of chip 14 and the temperature of heatsink 16. A typical set of curves for various Delta T and power levels is shown in FIG. 4. That is, curves for each of Delta T1, Delta T2, Delta T3, Delta T4, Delta T5, Delta T6 and each of power levels P1, P2, P3 are shown. After determining the level of power applied and the difference (Delta T) between the target temperature of chip 14 and the temperature of heatsink 16, microcontroller 24 derives values for R and C from the tables in memory 26.

In summary, the jetting thermal response of the print chip 14 mounted on heatsink 16 is dependent on the chip target temperature, the temperature of heatsink 16, and the power applied while jetting. Tables describing the thermal response are stored in memory 26 of the printer for a typical print chip 14.

In order to improve upon the accuracy of the R and C table values stored in memory 26, a machine calibration sequence is used to measure the values of R and C at a selected combination of power level and delta temperature level. A plot of this calibration sequence, which is performed whenever a new printhead is installed in the machine, is shown in FIG. 5.

Figure 5:
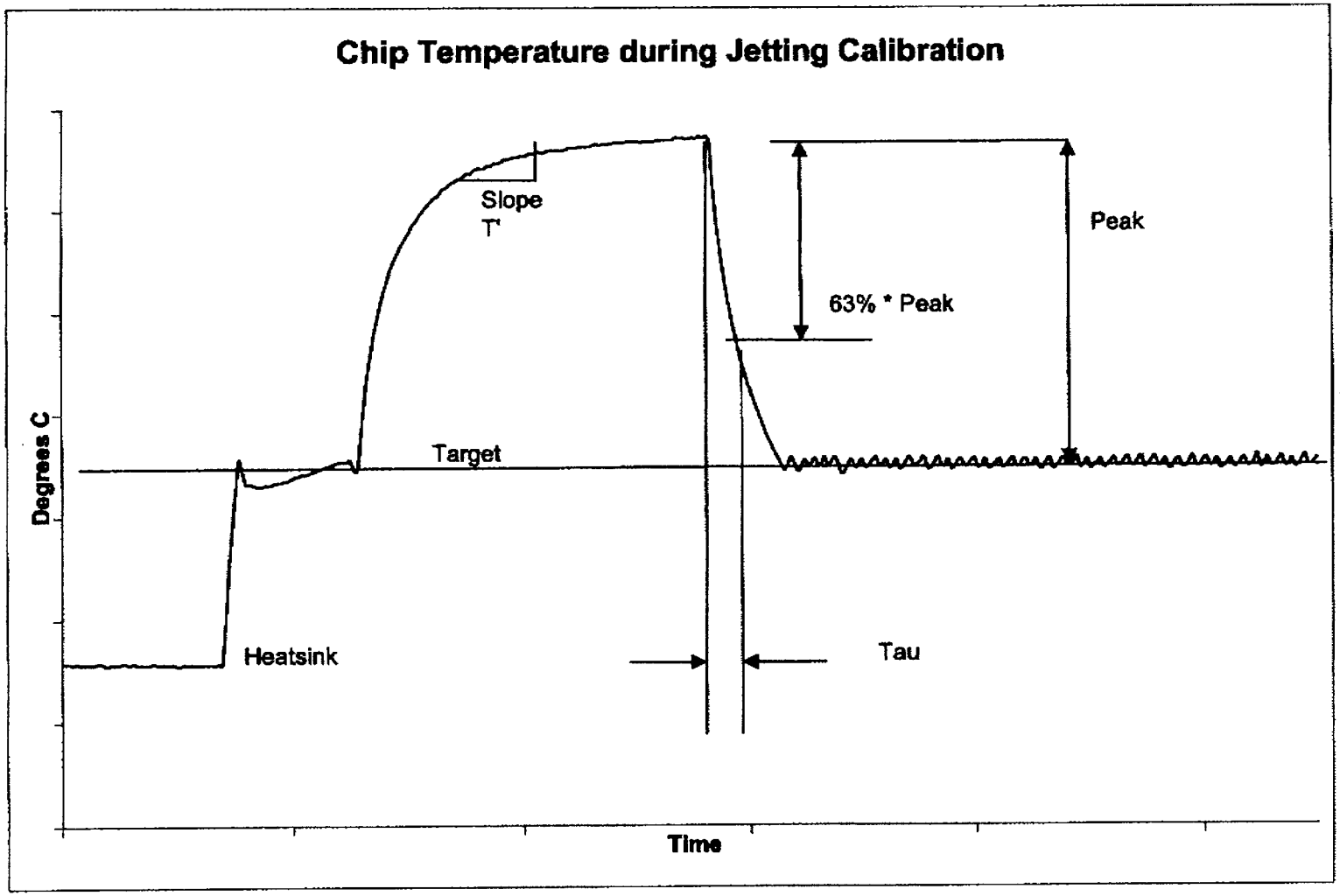
FIG. 5 is a plot of print chip temperature during a calibration sequence.
Figure 6:
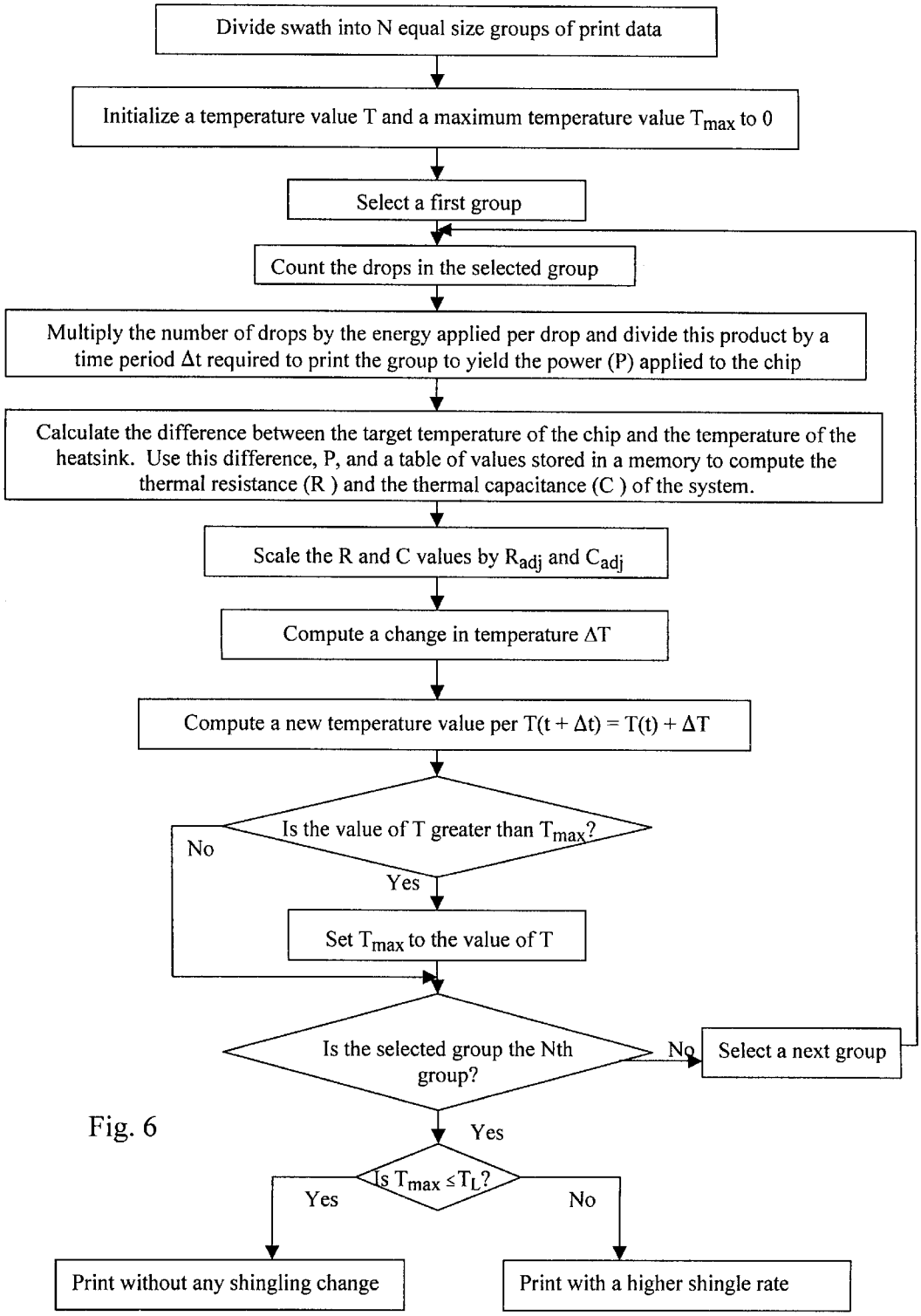
FIG. 6 is a flow chart of one embodiment of the method of the present invention.

To begin the calibration sequence, print chip 14 is heated to a known target temperature value above its heatsink temperature, as shown in FIG. 5. After the printer has moved printhead 10 into its spit location, jetting pulses are applied to printhead 10, and all nozzles 22 of printhead 10 are fired at a fixed duty cycle.

Jetting of nozzles 22 continues until the temperature of chip 14 has reached steady state, i.e., the rate of temperature change has dropped below a predetermined value. Dividing the change in temperature by the power applied results in a measured thermal resistance $R_m$. A ratio $R_{adj}$ of the nominal thermal resistance to $R_m$ is then stored in memory 26 for later use.

When jetting is stopped, the difference between the peak temperature and target temperature is computed and scaled by 37%. This value, 63% * Peak below the peak temperature, is added to the target temperature to form the time constant cooling detection temperature.

When the temperature of chip 14 falls below the cooling detection temperature, the time period Tau that was required to cool from the peak temperature to the cooling detection temperature is recorded. Dividing time period Tau by $R_m$ and the nominal C value yields $C_{adj}$. After the calibration sequence is complete, two scaling factors, $R_{adj}$ and $C_{adj}$, are used to adjust the R and C table values stored in memory 26.

In summary, the jetting calibration cycle measures the peak temperature of chip 14 while spitting at a fixed duty cycle. This peak temperature is then used to compute a thermal resistance value. While cooling, the thermal time constant is measured and used to compute the thermal capacitance value. The measured values are used with typical stored values to form a table adjustment value.

Before a swath is printed, the maximum print temperature across the swath for each print chip is predicted. This prediction process includes the following nine steps:

1. The swath is divided into equal size groups of print data. The group size is chosen such that the time required to print the group is much less than the product of R and C in Equation (1). Since R and C vary with the power level, the minimum values of R and C are used.

2. A temperature value T and a maximum temperature value $T_{max}$ are each initialized to 0.

3. The drops are counted in the group of interest and the number of drops is multiplied by the energy applied per drop. Dividing this product by a time period Δt required to print the group yields the power applied to the chip during time period Δt. In equation form, P=(Drop Count*Energy per Drop)/Δt 4. The difference between the target temperature of chip 14 and the temperature of heatsink 16 is calculated. Using this difference and the power computed in the previous step, the values of R and C are computed by using a table of values stored in memory 26. These tables are stored in memory 26 as a permanent part of the printer's operating system.

5. The R and C values stored in the table are scaled by $R_{adj}$ and $C_{adj}$.

6. With the scaled values of R and C from step 6, the change in temperature ΔT is computed per Equation (1).

7. A new temperature value is computed per the following Equation (3):

$$T(t+\Delta t)=T(t)+\Delta T \qquad \text{Equation (3).}$$

8. If the value of T computed in step 7 is greater than $T_{max}$, then $T_{max}$ is set to the value of T.

9. Steps 3 through 8 are repeated for all of the groups in the swath.

After all groups are processed, maximum temperature $T_{max}$ is compared to a predetermined upper limit $T_L$ which is based on desired print quality. If $T_{max}$ remains less than $T_L$, then the swath can be printed without any change to the present shingling mode. However, if $T_{max}$ exceeds $T_L$, then the printer can shingle the entire page at a higher rate or change to a higher shingle rate within the page.

More particularly, on a page in which the limit temperature will be exceeded during printing, the printer can do at least one of three things. First, the entire page can be shingled at a higher rate. Second, shingling can be performed at a first rate up until the swath in which the limit temperature will be exceeded. Then the shingling rate can be increased to a higher, second rate while printing that particular swath. The first shingling rate can be resumed after the swath of interest has been completed. Third, multi-pass printing can be performed during the swath of interest without paper motion.

Figure 7:
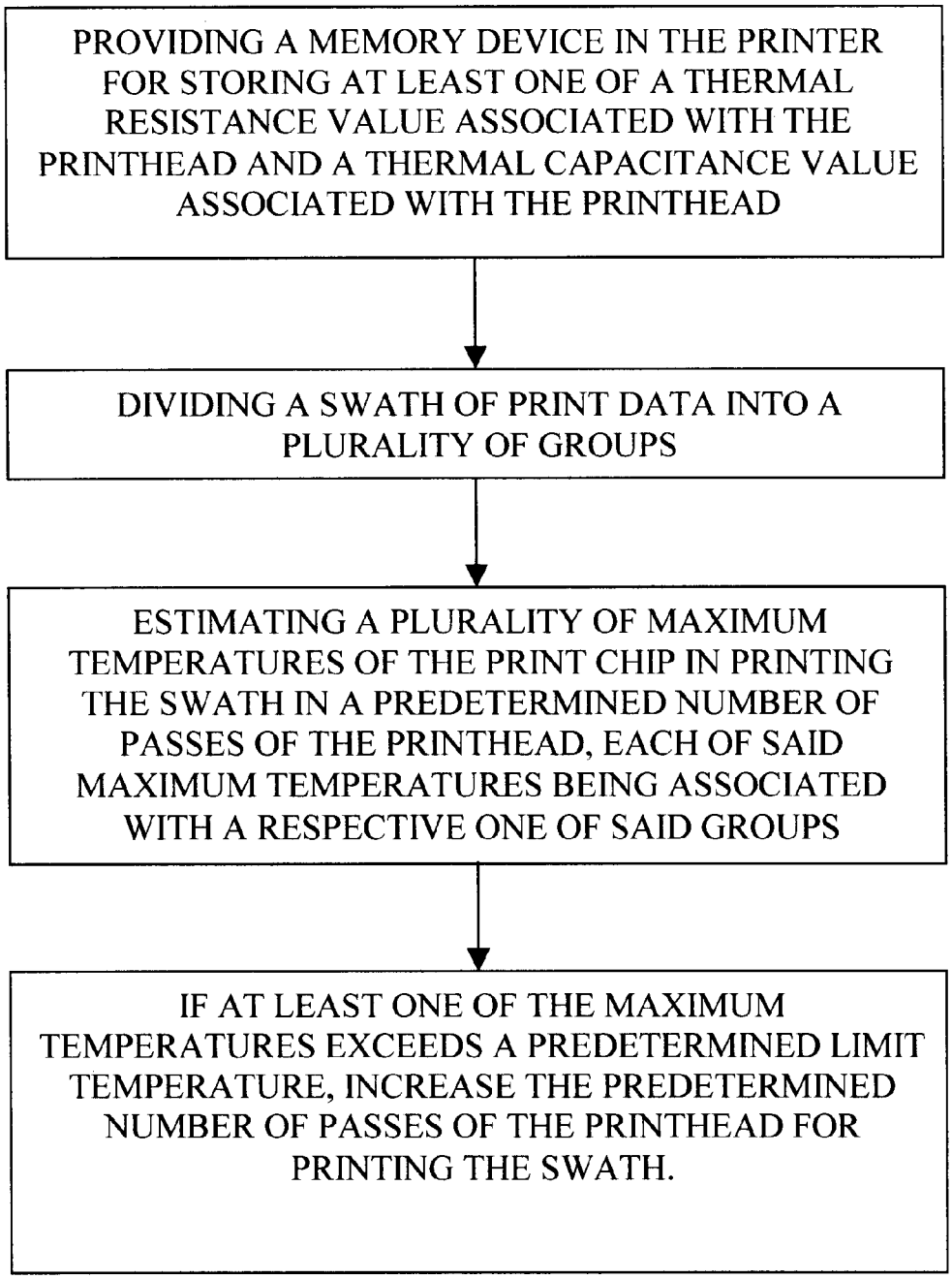
FIG. 7 is a flow chart of a method of controlling a temperature of a print chip based on an estimation of a plurality of maximum temperatures of the printing a swath.

In summary (see FIG. 7), each swath is broken into several smaller groups and within each group the power required to eject the ink is computed and used to look up chip thermal parameters. These parameters are adjusted based on calibration results and used to predict the change-in temperature for each group. Information stored in print chip memory 26 is used in the computation of group power.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of controlling a temperature of a print chip of a printhead in an ink jet printer, said method comprising the steps of:

providing a memory device within the printer;

emitting ink from the printhead;

recording temperature data associated with said print chip during said emitting step;

calculating at least one of a thermal resistance value associated with the printhead and a thermal capacitance value associated with the printhead, said calculating being dependent upon said recorded temperature data;

storing the at least one of a thermal resistance value associated with the printhead and a thermal capacitance value associated with the printhead in said memory device;

estimating a temperature of the print chip at a future point in time, said estimating step being based upon:

a number of ink drops to be emitted by the printhead before the future point in time; and the at least one of a thermal resistance value associated with the printhead and a thermal capacitance value associated with the printhead; comparing the estimated temperature to a predetermined limit temperature; and if the estimated temperature exceeds the predetermined limit temperature, reducing the number of ink drops to be emitted by the printhead before the future point in time.

2. The method of claim 1, wherein said emitting step comprises spitting ink while the printhead is in a spit location.

3. The method of claim 2, wherein said spitting occurs at a fixed duty cycle.

4. The method of claim 1, wherein said calculating step includes dividing a change in temperature of said print chip by an amount of power supplied in said emitting step to thereby yield a measured thermal resistance value.

5. The method of claim 4, wherein said storing step includes storing a ratio of a nominal thermal resistance value to the measured thermal resistance value.

6. The method of claim 4, wherein said calculating step includes:

computing a temperature difference between a peak temperature of the print chip and a target temperature of the print chip;

determining a cooling detection temperature by adding a predetermined fraction of the temperature difference to the target temperature of the print chip;

ascertaining a time period between a time of termination of said emitting step and a time at which a temperature of the print chip reaches the cooling detection temperature; and producing an adjusted thermal capacitance value by dividing the time period by the measured resistance and by a nominal thermal capacitance value.

7. The method of claim 6, wherein said storing step comprises storing the thermal resistance value in the memory device, said calculating step including:

using a ratio of a nominal thermal resistance value to the measured thermal resistance value to adjust the stored thermal resistance value.

8. The method of claim 6, wherein said storing step comprises storing the thermal capacitance value in the memory device, said calculating step including:

using the adjusted thermal capacitance value to adjust the stored thermal capacitance value.

9. The method of claim 4, wherein said estimating step includes calculating the amount of power supplied in said emitting step by multiplying the number of drops to be emitted by an estimated amount of energy applied per drop and dividing by a time period before the future point in time.

10. The method of claim 9, wherein the estimated amount of energy applied per drop is stored in the printhead.

11. The method of claim 9, comprising the further step of providing a heatsink attached to the print chip, said calculating step including determining a temperature difference between a target temperature of the print chip and a temperature of said heatsink.

12. The method of claim 1, wherein said estimating step comprises estimating a plurality of temperatures of the print chip at a plurality of future points in time, said future points in time all being within a common pass of the printhead across a print medium, consecutive said future points in time being separated by a separation time period, said separation time period being substantially less than a product of the thermal resistance value multiplied by the thermal capacitance value, said method comprising the further step of reducing a number of ink drops to be emitted by the printhead during the common pass if any of the estimated temperatures exceeds the predetermined limit temperature.

13. The method of claim 1, wherein if the estimated temperature exceeds the predetermined limit temperature in a selected swath, a planned number of passes of the printhead in which to print the selected swath is increased.

14. A method of controlling a temperature of a print chip of a printhead in an ink jet printer, said method comprising the steps of:

providing the printer with a memory device for storing at least one of a thermal resistance value associated with the printhead and a thermal capacitance value associated with the printhead;

estimating a temperature of the print chip at a future point in time, said estimating step being based upon:

a number of ink drops to be emitted by the printhead before the future point in time; and the at least one of a thermal resistance value associated with the printhead and a thermal capacitance value associated with the printhead;

comparing the estimated temperature to a predetermined limit temperature; and if the estimated temperature exceeds the predetermined limit temperature, reducing the number of ink drops to be emitted by the printhead before the future point in time.

15. The method of claim 14, comprising the further steps of:

repeating said estimating step at each of a plurality of additional future points in time, said future points in time all being within a common pass of the printhead across a print medium; and if any of the estimated temperatures exceeds the predetermined limit temperature, reducing a number of ink drops to be emitted by the printhead during the common pass.

16. A method of controlling a temperature of a print chip of a printhead in an ink jet printer, said method comprising the steps of:

dividing a swath of print data into a plurality of groups;

estimating a plurality of maximum temperatures of the print chip in printing the swath in a predetermined number of passes of the printhead, each of said maximum temperatures being associated with a respective one of said groups; and if at least one of the maximum temperatures exceeds a predetermined limit temperature, increasing the predetermined number of passes of the printhead for printing the swath.

17. A method of controlling a temperature of a print chip of a printhead in an ink jet printer, said method comprising the steps of:

dividing a swath of print data into a plurality of groups;

estimating a plurality of maximum temperatures of the print chip in printing the swath in a predetermined number of passes of the printhead, each of said maximum temperatures being associated with a respective one of said groups;

if at least one of the maximum temperatures exceeds a predetermined limit temperature, increasing the predetermined number of passes of the printhead for printing the swath; and providing a memory device in the printer for storing at least one of a thermal resistance value associated with the printhead and a thermal capacitance value associated with the printhead.

18. The method of claim 17, wherein each of the groups has a respective associated time period for a pass of the printhead across the group, each said time period being substantially less than a product of the thermal resistance value multiplied by the thermal capacitance value.

19. The method of claim 18, wherein said estimating step is based upon:

a number of ink drops to be emitted by the printhead during a pass across the groups; and the at least one of a thermal resistance value associated with the printhead and a thermal capacitance value associated with the printhead.

20. An ink jet printer comprising:

a printhead including a print chip;

a memory device storing at least one of a thermal resistance value associated with the printhead and a thermal capacitance value associated with the printhead; and a controller configured to:

retrieve the at least one of a thermal resistance value associated with the printhead and a thermal capacitance value associated with the printhead from said memory device; and calculate a maximum temperature of said print chip during printing based upon the at least one of a thermal resistance value associated with the printhead and a thermal capacitance value associated with the printhead.

21. The ink jet printer of claim 20, wherein said printhead includes a heatsink attached to said print chip.

22. The ink jet printer of claim 21, wherein said print chip includes a temperature sensing device and at least one substrate heater.

23. The ink jet printer of claim 20, wherein said controller is configured to adjust the at least one of a thermal resistance value associated with the printhead and a thermal capacitance value associated with the printhead based upon temperature data received from said temperature sensing device.

* * * * *